US010731311B2

(12) United States Patent
Bernasinski et al.

(10) Patent No.: US 10,731,311 B2
(45) Date of Patent: Aug. 4, 2020

(54) MACHINE AND METHOD FOR INSTALLING VERTICAL DRAINS IN THE GROUND

(71) Applicant: SOLETANCHE FREYSSINET, Rueil-Malmaison (FR)

(72) Inventors: Régis Bernasinski, Rueil-Malmaison (FR); Todd Springer, Rueil-Malmaison (FR); Benoit Fernando Quandalle, Rueil-Malmaison (FR)

(73) Assignee: SOLETANCHE FREYSSINET, Rueil-Malmaison (FR)

( * ) Notice: Subject to any disclaimer, the term of this patent is extended or adjusted under 35 U.S.C. 154(b) by 0 days.

(21) Appl. No.: 16/077,048

(22) PCT Filed: Feb. 14, 2017

(86) PCT No.: PCT/FR2017/050330
§ 371 (c)(1),
(2) Date: Aug. 10, 2018

(87) PCT Pub. No.: WO2017/140977
PCT Pub. Date: Aug. 24, 2017

(65) Prior Publication Data

US 2019/0040599 A1 Feb. 7, 2019

(30) Foreign Application Priority Data

Feb. 16, 2016 (FR) ..... 1651244

(51) Int. Cl.
*E02D 3/10* (2006.01)
*E02D 7/14* (2006.01)

(52) U.S. Cl.
CPC ..... *E02D 3/103* (2013.01); *E02D 7/14* (2013.01); *E02D 2600/10* (2013.01); *E02D 2600/30* (2013.01); *E02D 2600/40* (2013.01)

(58) Field of Classification Search
CPC ..... E02D 11/00
See application file for complete search history.

(56) References Cited

U.S. PATENT DOCUMENTS 4,428,699 A * 1/1984 Juhola ..... E02D 3/103 405/36

FOREIGN PATENT DOCUMENTS

FR 2518607 A1 6/1983

* cited by examiner

*Primary Examiner* — Sean D Andrish
(74) *Attorney, Agent, or Firm* — Workman Nydegger; Matthew D. Todd

(57) ABSTRACT

The invention relates to a machine for putting a drain into place in ground, the machine comprising a drive tube presenting a longitudinal axis and having a bottom end; a movement device for moving the drive tube in a direction parallel to the longitudinal axis; a drain extending inside the drive tube and having a bottom end extending outside the drive tube; at least one anchor; a fastener device (70) for fastening the anchor to the drain; and a cutter member for cutting the drain (18) and arranged under the fastener device. The machine of the invention further comprises a cutter device (60) for cutting the anchor from a strip (54).

19 Claims, 13 Drawing Sheets

MACHINE AND METHOD FOR INSTALLING VERTICAL DRAINS IN THE GROUND

BACKGROUND

The present disclosure relates to the field of improving ground, and more particularly to techniques for draining ground.

It is known to use drains, generally vertical drains, for consolidating and stabilizing ground that is soft and compressible, such as clayey ground. In particular, vertical drainage is generally used for accelerating the consolidation of relatively impermeable soft terrain supporting a heavy load, such as for example filling material. The presence of drains serves specifically to accelerate the removal of water from the ground, thereby enabling the ground to be consolidated in a few months. In contrast, in the absence of drainage, the consolidation or settling phenomenon can last for several years, which runs the risk of damaging the structure constructed on ground that has not been treated.

In order to drain ground, it is known to make use of machines for inserting drains in the form of elongate wicks vertically into the ground.

The disclosure relates to such a machine for putting a drain into place in ground, the machine comprising:

- a drive tube presenting a longitudinal axis and having a bottom end;
- a movement device for moving the drive tube in a direction parallel to the longitudinal axis;
- a drain extending inside the drive tube and having a bottom end extending outside the drive tube;
- at least one anchor;
- a fastener device for fastening the anchor to the drain; and
- a cutter member for cutting the drain and arranged under the fastener device.

Such a machine is described in particular in FR 2 518 607.

In the method described in that document, the anchor is fastened in automatic manner to the drain, and then the drain together with the anchor are driven into the ground during the vertical descent of the drive tube. After reaching the desired depth, the drive tube is raised, leaving the drain in the ground because of the anchor that prevents the drain from rising.

In that document, the anchors are constituted by individual plates that are previously stored in a magazine. On each cycle, a plate is brought up to the drain in order to be stapled to the drain. That document also proposes another variant in which, instead of using a magazine of individual anchors, the anchors are detached from a strip scored with lines of weakness.

Nevertheless, that machine presents the drawback of being particularly expensive to fabricate since it requires individual anchors to be cut apart beforehand or else it requires prior machining of lines of weakness in a strip. Also, storing anchors in a magazine in the form of individual plates is generally not compatible with the working conditions encountered on a work site, such as vibration, sudden movements, or indeed the presence of mud.

Also, if the operator desires to change the size or the type of anchor, e.g. because of a local variation in the structure of the ground, it is necessary to act on the machine in order to reload the individual anchor magazine or else to replace the strip with a strip having lines of weakness in a different arrangement, thereby making it necessary to interrupt work on site in order to intervene on a machine so as to make such changes. Furthermore, there is a risk of accidents resulting from handling plates, since they are generally made of metal and are sharp.

SUMMARY

An object of the disclosure is to propose a machine for making drains in ground while remedying the above-mentioned drawbacks.

Embodiments of the disclosure achieve this by the fact that the machine of the disclosure further comprises a cutter device for cutting the anchor from a strip.

Thus, the machine itself can produce anchors by cutting them from a strip, on request and to the desired size, in a manner that is simple and inexpensive, without requiring the presence of a human operator in the proximity of the bottom end of the drive tube. The machine of the disclosure is thus safer and less burdensome than the prior art machine.

Furthermore, in the meaning of the disclosure, the term "ground" is used to cover ground on land or under the sea. In other words, the machine of the disclosure can be used for putting drains into place both in terrain on land and in a seabed.

Advantageously, the machine further comprises an actuator device for simultaneously actuating the cutter device and the fastener device.

In other words, the anchor is cut from the strip and the cut off anchor is fastened to the drain at the same time, thereby putting drains into place faster, and thus accelerating work on site.

Advantageously, the cutter device is configured to slice the strip. To do this, it advantageously comprises a blade for cutting the anchor from the strip.

In an advantageous embodiment, the machine includes an assembly station comprising the fastener device and the cutter device, and a feeder device for feeding a free end part of the strip into the assembly station.

Preferably, the feeder device is configured to feed the free end part parallel with and facing the drain. Also preferably, the free strand of the strip extends perpendicularly to the longitudinal axis of the drive tube.

In a preferred embodiment, the machine further comprises a reel for receiving the rolled up strip in the form of a roll. Preferably, but not exclusively, the reel is surmounted by a cover in order to protect the roll.

Preferably, the reel is mounted to rotate relative to a support of the machine.

Advantageously, the feeder device includes a device for un-rolling at least part of the strip, which device is preferably in the form of two rotary cylinders having axes of rotation that are parallel to the axis of rotation of the reel. Causing the cylinders to rotate in contrarotation has the effect of pulling on the free strand of the strip and of driving rotation of the reel carrying the strip, thereby having the effect of un-rolling the roll.

In a preferred embodiment, the reel is mounted to rotate about an axis of rotation that is parallel to the longitudinal axis of the drive tube.

It can be understood that, after the anchor has been cut from the strip and moved down the drive tube, the device for un-rolling at least part of the strip is actuated so as to bring the free end part of the strip into register with the drain and the cutter device.

In an advantageous variant, the cutter device includes a setting member for modifying the length of the anchor cut from the strip. The setting member serves to modify the position of the cutter device relative to the free end of the strip. Preferably, the setting member also serves to change the position of the free end of the strip relative to the drain, so as to center the anchor for cutting off relative to the drain.

In a preferred embodiment, the fastener device is configured to fasten the anchor to the drain by crimping.

One advantage is to be able to fasten the anchor to the drain in robust manner, without any additional fastener part, such as a screw or a staple, for example. In particular, this makes it possible to avoid interrupting the operation of the machine in order to refill the supply of consumables, thereby further reducing the cost of operating the machine. Risks of accident are also reduced by avoiding the presence of an operator in the proximity of the drive tube and the fastener device.

Advantageously, the crimping fastener device has means for piercing the drain and the anchor, the anchor preferably being pierced without removing material.

Preferably, the fastener device has one or more punches configured to perform crimping by punching the drain and the anchor. Preferably, the punching is accompanied by the punched material being folded onto the drain so as to secure the drain to the cut-off anchor.

In an advantageous embodiment, the machine of the disclosure further comprises an adjuster device for increasing the length of the drain portion that is located under the cutter member.

Thus, by means of embodiments of the disclosure, it is easy to adjust the length of the drain portion above the ground, which presents an advantage in particular when the drain needs to be connected to a horizontal drainage system.

Preferably, the adjuster device comprises a first roller and a second roller that is movable relative to the first roller, the second roller presenting an active position and a retracted position, rotation of at least one of the first and second rollers being motor-driven, the first and second rollers being configured to pinch the drain when the second roller is in the active position so as to be able to un-roll the drain.

Embodiments of the disclosure thus make it simple to adjust the length of the drain portion that emerges from the ground, in automated manner without the presence of an operator, thereby further serving to reduce the risk of any accident.

Advantageously, the machine of the disclosure further comprises a blocking device for holding the drain portion that is located under the cutter member.

An advantage is to be able to facilitate the operation of cutting the drain, while the drain is being held, preferably under tension, during the operation of cutting the drain by the cutter member.

In an advantageous embodiment, the adjuster device and the blocking device form a single element. Thus, and preferably, the blocking device comprises the above-mentioned first and second rollers. These rollers thus advantageously present two functions, namely both adjusting the length of the drain portion that emerges from the ground, and also blocking the drain portion arranged under the cutter member, preferably prior to cutting the drain.

Thus, the cutter member is arranged between the assembly station and the blocking device, whereby the drain can be tensioned between the assembly station and the blocking device while it is being cut, thereby facilitating the operation of cutting the drain.

Advantageously, the machine of the disclosure further comprises a mast having a bottom end, the drive tube being movable relative to the mast in a substantially vertical direction, and the cutter device, the fastener device, and the cutter member for cutting the drain are arranged in a module that is releasably fastened to the bottom end of said mast.

Thus, by means of this modular system, the disclosure makes it possible in simple manner to transform a carrier into a machine for putting a drain into place.

The disclosure also provides an assembly constituted by a machine of the disclosure and at least one strip rolled up in the form of a roll. Preferably, the strip is in the form of a roll. The width of the strip lies in the range of 70 millimeters (mm) to 150 mm, and its thickness preferably lies in the range 1 mm to 2.5 mm. Advantageously, the strip presents thickness that is constant.

The disclosure also provides a method of putting a drain into place in ground, the method comprising the following steps:

- providing both a machine of the disclosure, and also a rolled up strip;
- fastening a first anchor to the bottom end of the drain;
- driving the first anchor connected to the drain into the ground by moving the drive tube vertically into the ground so that the drain presents a first drain portion extending between the first anchor and the drain cutter member, and a second drain portion located out of the ground and extending the first drain portion, the first drain portion presenting a bottom part arranged in the ground and a top part arranged out of the ground;
- raising the drive tube, while leaving the first anchor and the bottom part of the first drain portion in the ground;
- un-rolling part of the strip and cutting a second anchor from the strip by using the cutter device;
- fastening the second anchor to the second drain portion by using the fastener device;
- cutting the drain under the second anchor by using the cutter member in order to separate the first drain portion from the second drain portion;
- moving the machine;
- driving the second anchor connected to the second drain portion into the ground by moving the drive tube into the ground; and
- raising the drive tube while leaving the second anchor and a length of the second drain portion in the ground.

It can be understood that the steps are advantageously repeated in order to place a plurality of drains vertically in the ground one beside another.

Preferably, after cutting the drain under the second anchor, the second drain portion is pulled so as to bring the second anchor into contact with the bottom end of the drive tube. An advantage is to close the bottom end of the drive tube so as to prevent fragments of ground penetrating into the drive tube.

Advantageously, and if necessary, after raising the drive tube and before fastening the second anchor to the second drain portion, the drain is un-rolled in order to increase the length of the top part of the first drain portion.

Advantageously, the second anchor is cut from the strip while said second anchor is being fastened to the second drain portion.

Preferably, the fastening is performed by crimping. Also preferably, the crimping is performed by punching.

Advantageously, the first drain portion and/or the second drain portion is/are blocked by pinching before cutting the drain.

BRIEF DESCRIPTION OF THE DRAWINGS

The disclosure can be better understood on reading the following description of an embodiment of the disclosure given as a nonlimiting example and with reference to the accompanying drawings, in which.

DETAILED DESCRIPTION

Figure 1:
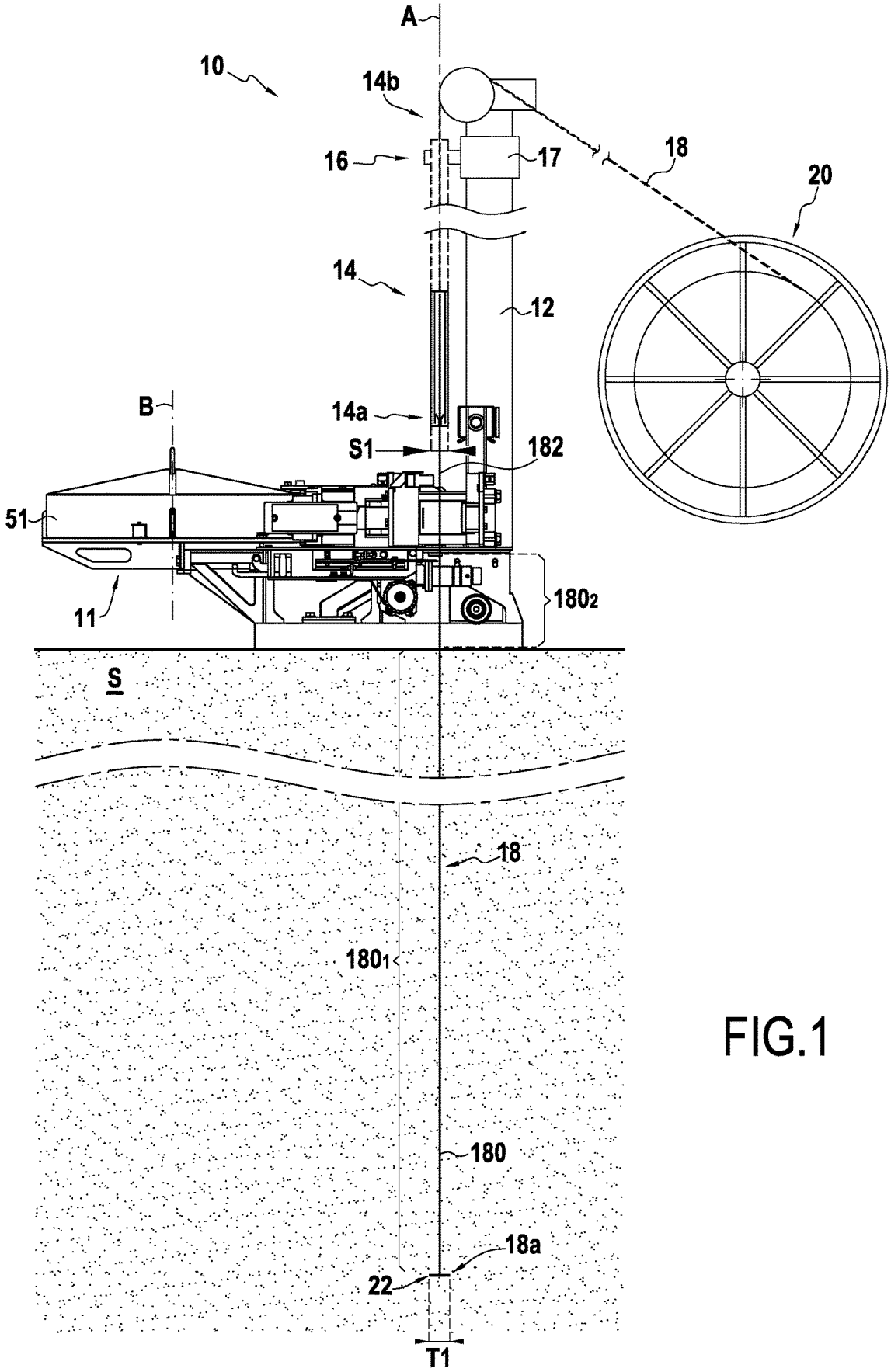
FIG. 1 is a side view of the machine of the disclosure, after a first drain provided with a first anchor has been inserted in the ground.

In FIG. 1, there can be seen an embodiment of a machine 10 for placing one or more drains in ground S, e.g. in clayey ground. In this example, the drains are in the form of elongate wicks.

The machine 10 is for attaching to a carrier, e.g. a crawler carrier (not shown). By way of example, one such carrier is described in particular in U.S. Pat. No. 5,658,091. The machine 10 has a mast 12 that extends in a vertical direction. The machine also includes a drive tube 14 that has a bottom end 14*a* and that extends along a longitudinal axis A. The drive tube is in the form of a hollow elongate tube that extends parallel to the mast 12.

The machine 10 also has a movement device 16 in the form of a carriage 17 that is movable along the mast 12 so as to move the drive tube 14 in a direction parallel to the longitudinal axis A. This example is not limiting, and other movement devices could be used.

In this example, it can be understood that moving the carriage 17 in translation along the mast 12 has the effect of moving the drive tube 14 vertically, and consequently serves to insert the bottom end 14*a* of the drive tube 14 into the ground S.

The machine 10 also includes a drain 18 that, in this example, is in the form of an elongate flexible wick. The drain is initially stored on a winder 20 that is mounted on the carrier. As can be seen in FIG. 1, the drain 18 is guided by a pulley at the top end of the mast and then extends vertically inside the drive tube 14, passing through said tube from its top end 14*b* to its bottom end 14*a*. Furthermore, the drain has a bottom end 18*a* that extends outside the drive tube 14 below its bottom end 14*a*.

The machine 10 also has a first anchor 22, which is fastened to the drain 18 in the proximity of its bottom end 18*a*. It can be seen that the greatest transverse dimension T1 of the first anchor 22 is greater than the cross-section S1 of the bottom end 14*a* of the drive tube 14, such that the first anchor closes the bottom end of the drive tube while it is being moved down into the ground, thereby preventing matter from entering into the drive tube.

In FIG. 1, it can be seen that the drain extends substantially vertically in the ground S.

Figure 2:
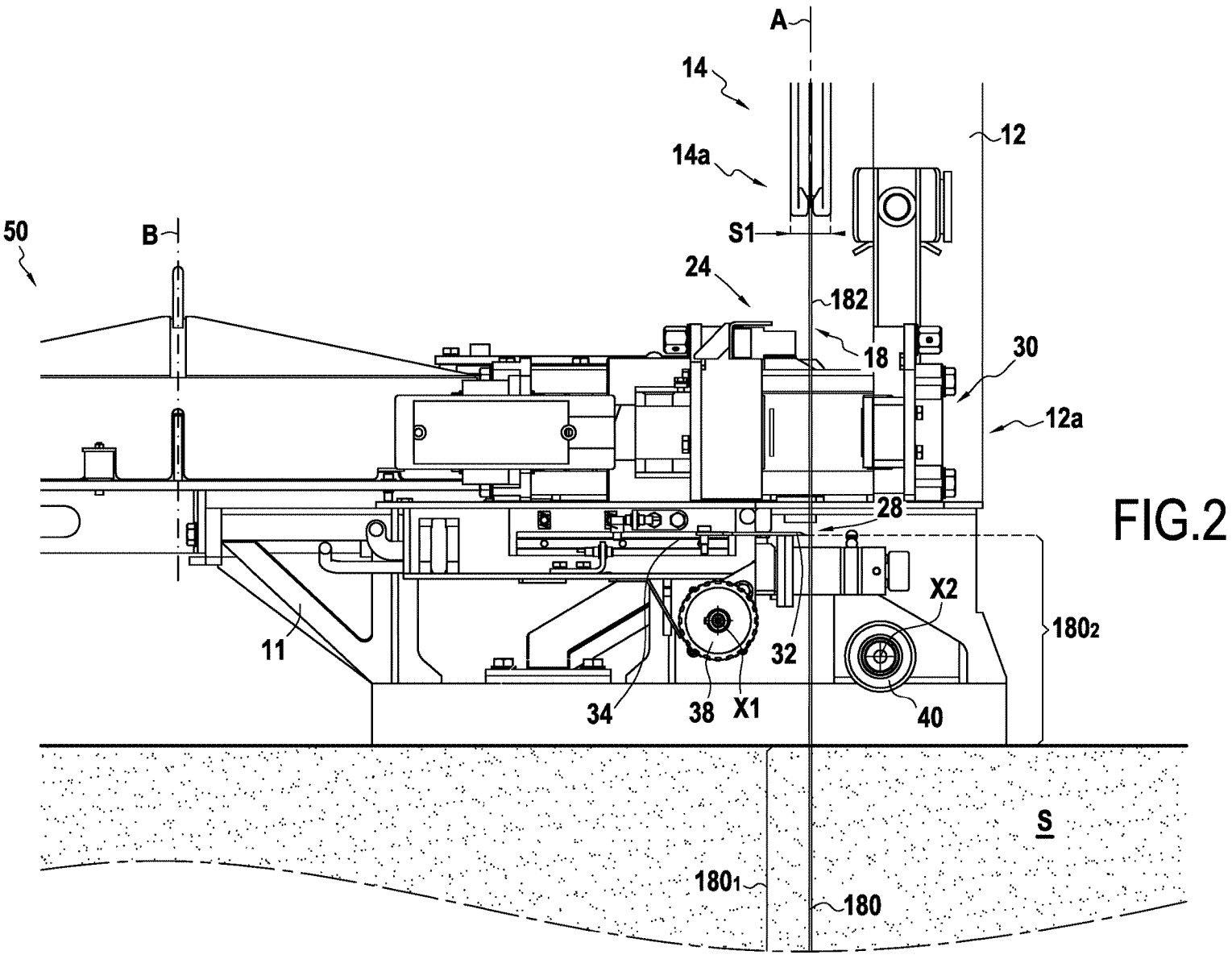
FIG. 2 is a detail view of the assembly station of the FIG. 1 machine.

With reference to FIG. 2, the machine 10 also has a module 24 that is releasably fastened to a bottom end 12*a* of the mast 12. The module 24 includes a cutter member 28 for cutting the drain 18, which member is arranged under an assembly station 30. The cutter member 28 comprises a knife 32 that is movable transversely relative to the drain in order to be able to cut it. In this example, the knife 32 is movable in a horizontal direction. The cutter member 28 is connected to a mover member 34, in this example a hydraulic actuator, that the operator can control in order to cut the drain.

Figure 3A:
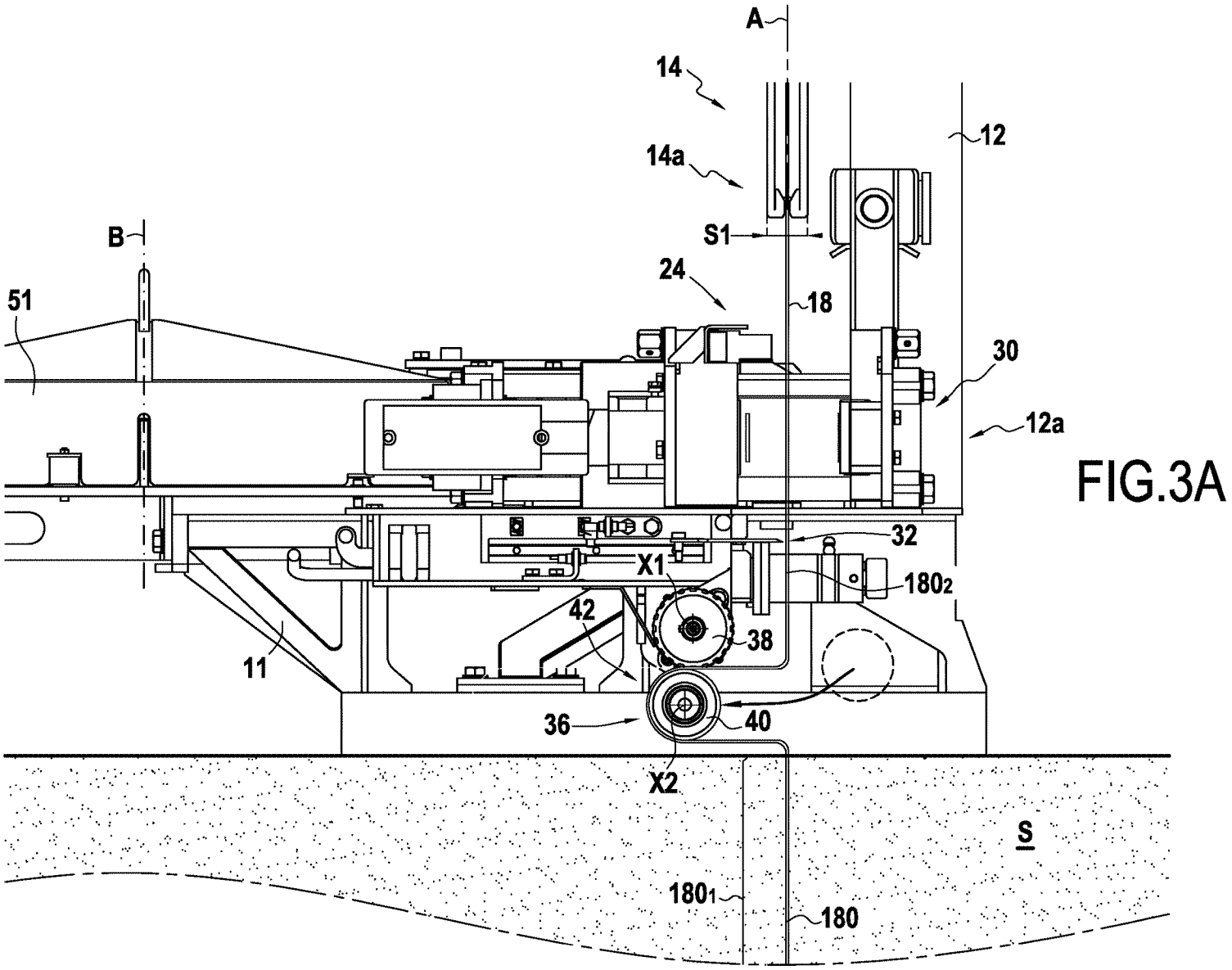
FIG. 3A shows actuation of the drain blocking device.
Figure 3B:
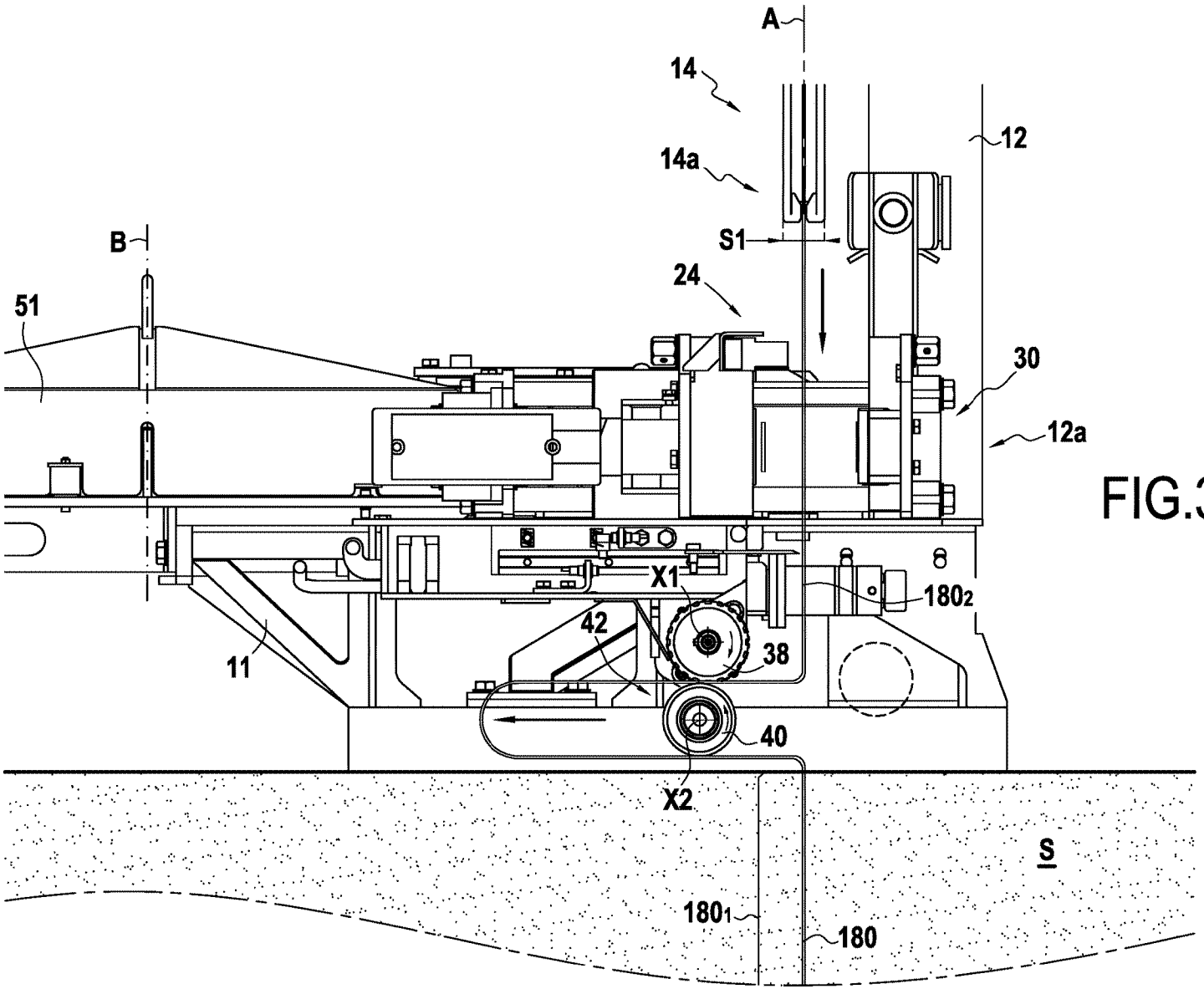
FIG. 3B shows increasing the portion of the drain that emerges from the ground by the action of the adjuster device.

The machine 10 also has an adjuster device 36, which can be seen more clearly in FIGS. 3A and 3B, for the purpose of increasing the length of the portion of drain that is to be found under the cutter member 28. The adjuster device 36 comprises a first roller 38 that presents a first axis of rotation X1 that extends transversely relative to the longitudinal axis of the drive tube, and a second roller 40 that presents a second axis of rotation X2, parallel to the first axis of rotation X1. The first roller 38 is mounted to rotate about the axis X1 relative to a support 11 of the machine. The second roller 40 presents both an active position, as shown in FIGS. 3A and 3B, and a retracted position, as shown in FIG. 2. The second roller 40 is rotatably fastened to the end of an arm (not shown), the arm being pivotally mounted relative to the support 11 so as to cause the second roller 40 to pass from its retracted position to its active position, as shown diagrammatically in FIG. 3A, and vice versa.

As can be seen in FIG. 3A, the first and second rollers 38 and 40 are configured to pinch the drain 18 when the second roller 40 is in its active position. In this example, the first roller 38 is motor driven so that causing it to rotate in a clockwise direction has the effect of unwinding the drain, thereby causing the winder 20 to rotate, and also increasing the portion of drain and that is to be found under the cutter member 28, as shown in FIG. 3B.

The above-described adjuster device 36 constitutes a blocking device 42 for holding the portion of drain that is under the cutter member 28, which blocking is obtained by the drain being pinched between the first and second rollers 38 and 40.

Figure 4A:
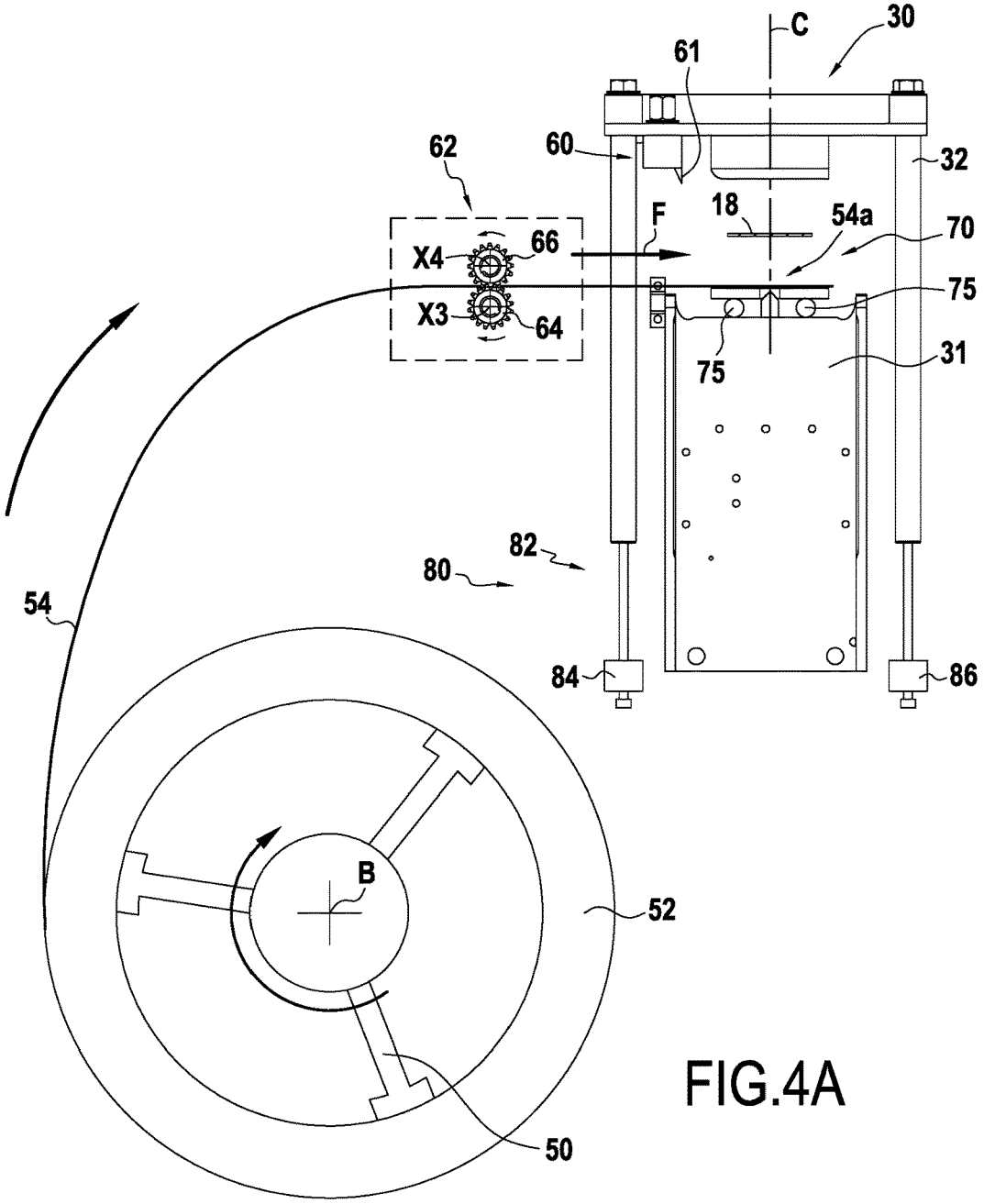
FIG. 4A is a plan view of the machine showing the free end part being fed into the assembly station.
Figure 4B:
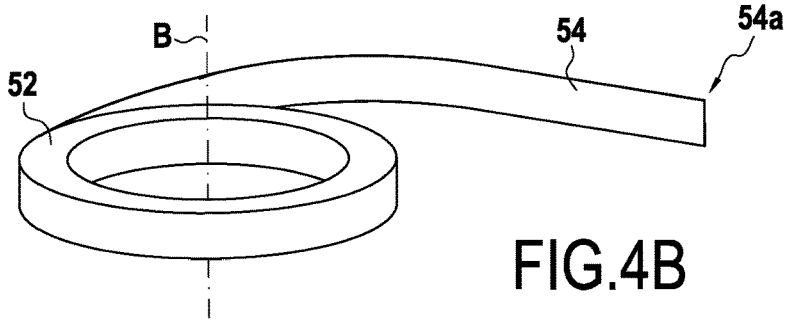
FIG. 4B is a detail view of the strip rolled up in the form of a roll.

With reference to FIGS. 1, 4A and 4B, it can be seen that the machine 10 also includes a reel 50 that is mounted to rotate relative to the support 11 of the machine 10 about an axis of rotation B that is parallel to the longitudinal axis A of the drive tube.

The reel 50 is for receiving a roll 52, visible in FIG. 4B, constituted by a rolled up strip 54.

In this nonlimiting example, the strip is made of metal and presents a width of about 80 mm and a thickness of about 1 mm.

In accordance with the disclosure, the machine 10 also includes a device 60 forming part of the assembly station 30 for the purpose of cutting an anchor from the strip 54.

As shown in FIG. 4A, the assembly station 30 also includes a feed device 62 constituted by two contrarotating cylinders 64 and 66 that clamp onto a portion of the strip 54 and that are arranged to feed a free end part 54*a* of the strip 54 into the assembly station 30. The first and second cylinders 64 and 66 are mounted to contrarotate about two axes of rotation X3 and X4 that are parallel to each other and parallel to the axis of rotation B of the roll. When the first and second cylinders 64 and 66 are actuated, the free end part 54*a* of the strip 54 is moved in a feed direction represented by arrow F so as to be placed facing the drain 18.

The assembly station 30 also includes a stand 31 secured to the support 11, together with a body 32 that is movable in translation relative to the stand 31 in a direction C perpendicular to the drain 18 and to the feed direction F. The direction C is also perpendicular to the large faces of the free end part 54*a* of the strip 54. The cutter device has a blade 61 that is secured to the body 32 in order to cut the anchor from the strip when the body moves relative to the stand.

The machine 10 also has a fastener device 70 for fastening to the drain the anchor that has been cut off by the cutter device 60.

Figure 5A:
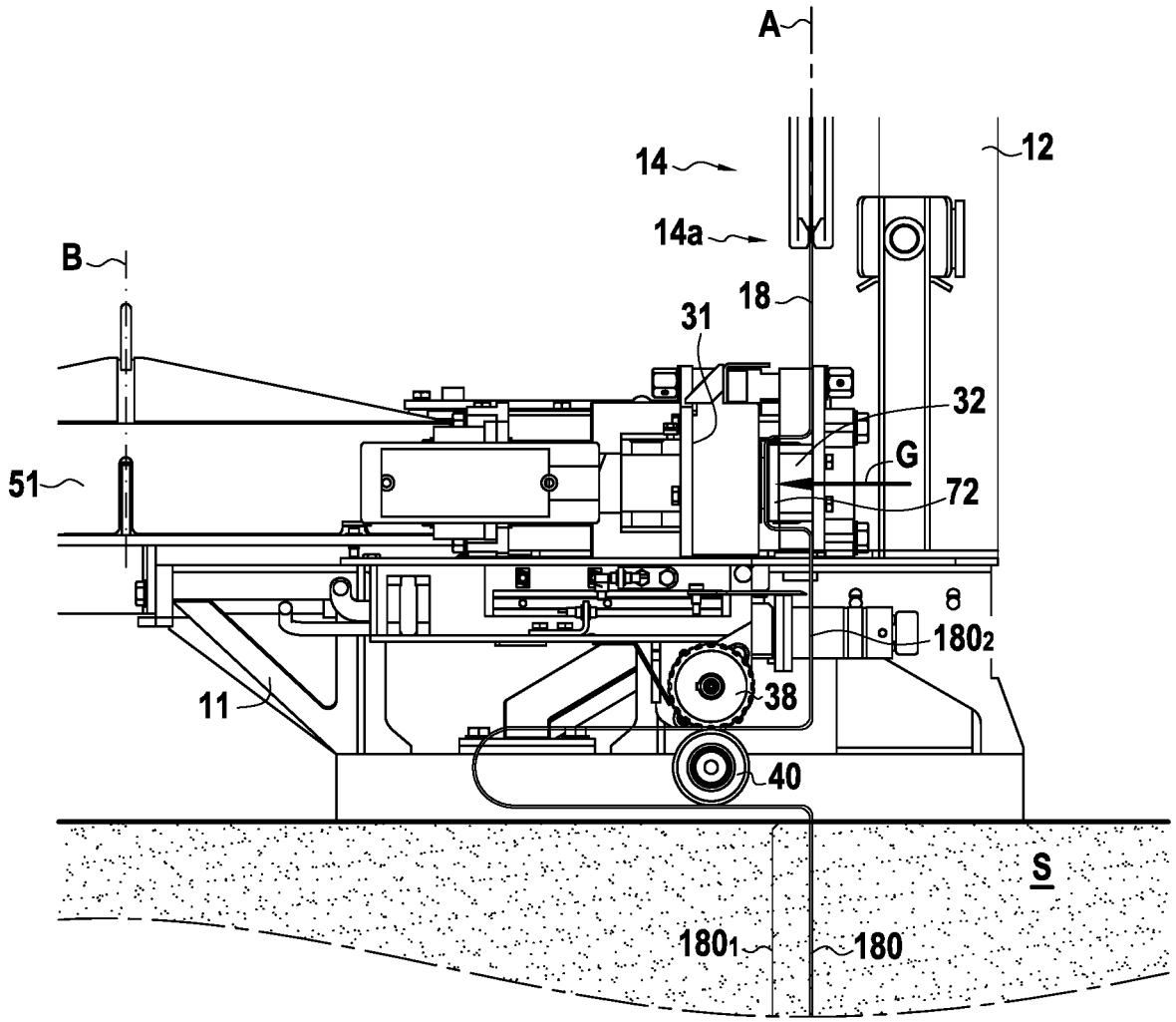
FIGS. 5A to 5C show the step of cutting a second anchor from the strip and the corresponding step of fastening the second anchor to the drain.
Figure 5B:
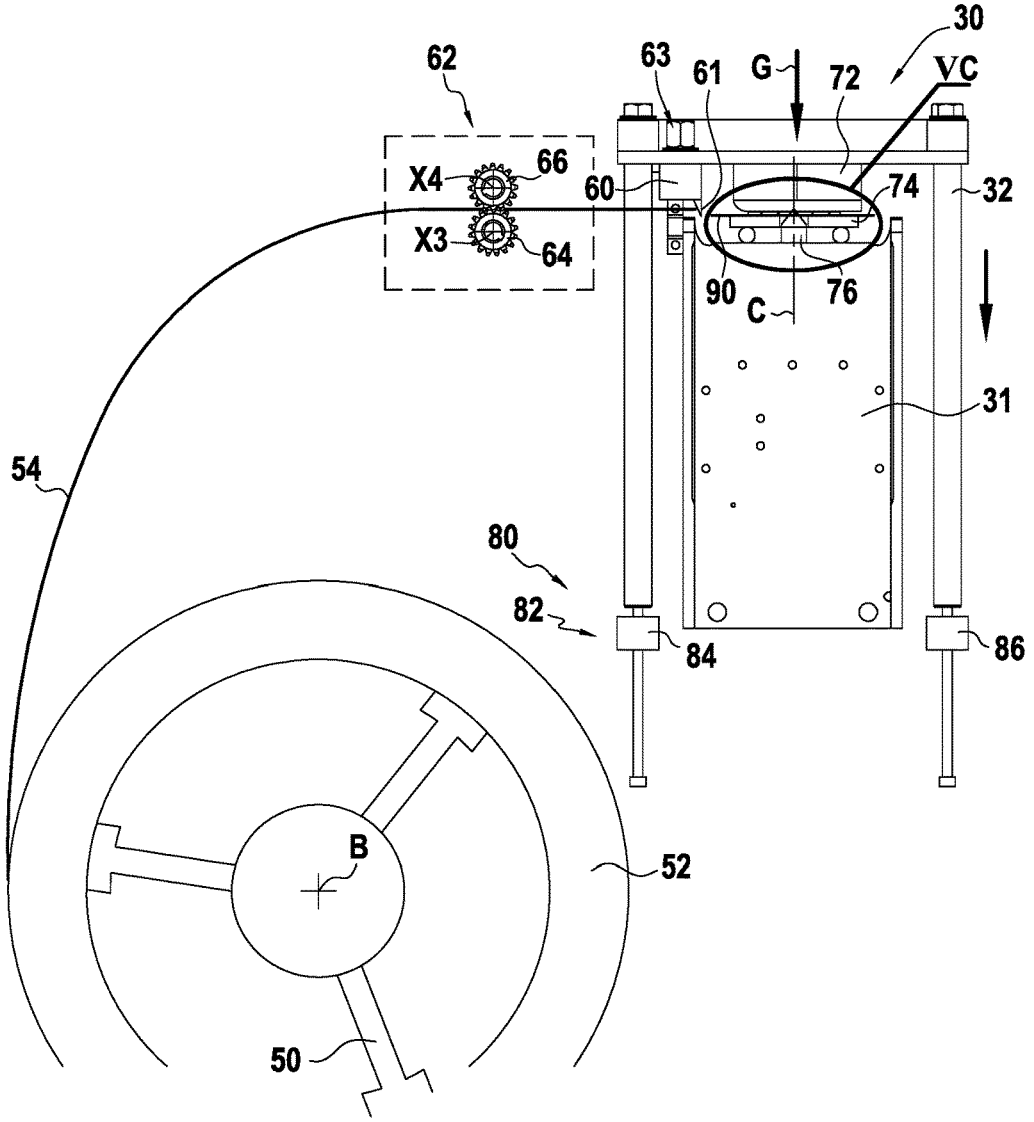
Figure 5C:
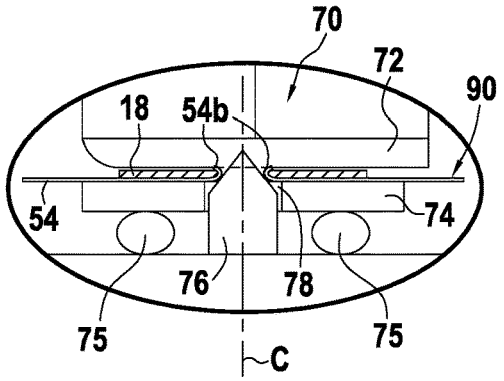

The fastener device 70, which can be seen in FIG. 5C, has a first plate 72 that is fastened to the body 32, and a second plate 74 that is secured to the stand 31. The second plate 74 is mounted on resilient cushions 75 for a purpose that is explained below.

The fastener device also has a punch 76 fastened to the stand 31 and configured to pass through the thickness of the second plate 74 via an orifice 78 formed in said second plate 74, whenever the second plate 74 moves towards the stand 31 in direction C. The cushions 75 constitute return springs that enable the punch 76 to be retracted relative to the second plate 74 when no pressure is being exerted on said second plate.

With reference to FIGS. 4A, 5A, and 5B, it can be seen that the machine 10 also has an actuator device 80 for actuating the cutter device 60 and the fastener device 70 simultaneously. In this nonlimiting example, the actuator device 80 comprises a movement device 82 with two actuators 84 and 86 that serve to move the body 32 relative to the stand 31 along the direction C. More precisely, the function of the actuator device is to move the body 32 relative to the stand 31 in the movement direction G shown in FIGS. 5A and 5B.

The effect of moving the body 32 relative to the stand is firstly to move the blade 61 of the cutter device 60 so that it slices through the strip 54 across its entire width, thereby separating the anchor 90 from the remainder of the strip.

Simultaneously, actuating the actuators 84 and 86 has the effect of moving the first plate 72 in the direction G, thereby pressing the first plate 72 against the drain 18 and bringing it into contact with the free end part 54*a* of the strip 54, and then pushing the drain and the end together against the second plate 74. At this stage, the drain and the anchor 90 as cut from the remainder of the strip 54 are sandwiched between the first plate 72 and the second plate 74. Continued combined movement of the first plate 72, of the drain 18, of the anchor 90, and of the second plate 74 has the effect of flattening the cushions 75 and of causing the punch 76 to emerge from the second plate 74.

The punch 76 then perforates the free end part 54*a* of the strip 54, together with the drain 18. With reference to FIG. 5B, it can be understood that in its punching movement, the punch 76 perforates the free end part 54*a* of the strip while pushing back the material from which the strip is made, so as to form a ring of metal 54*b*, which ring is simultaneously folded by the first plate 72 against the drain 18. This achieves fastening by crimping as a result of the combined action of the punch 76 and of the first plate 72 being pressed against the second plate 74. Naturally, other methods of fastening by crimping could be used, without going beyond the ambit of the present disclosure.

Simultaneously with the fastening operation, it can be understood that the blade 60 cuts off the anchor 90, thereby having the effect of detaching it from the remainder of the strip 54.

It is also specified that the cutter device 60 further includes a setting member 63 for modifying the length of the anchor 90 cut off from the strip 54. In this nonlimiting example, the setting member 63 is configured to modify the position of the blade 61 relative to the strip in a direction parallel to the feed direction F. In another variant, the setting member 63 may be actuated automatically by the user.

With reference to FIGS. 1 to 11, there follows a detailed description of an implementation of the method of putting a drain 18 into place in ground S, which method makes use of the above-described machine 10.

In this method, use is made of a strip 54 of metal that is rolled up to form a roll that is placed on the reel 50. In FIG. 1, a first anchor 22 has been fastened to the bottom end 18*a* of the drain 18, and the first anchor 22 has been driven into the ground by moving the drive tube 14 vertically into the ground. Thus, the drain 18 presents a first drain portion 180 that extends between the anchor 22 and the cutter member 28. The drain 18 also has a second drain portion 182 arranged outside the ground S extending the first drain portion 180. The first drain portion 180 also presents a bottom part $\mathbf{180}_1$ arranged in the ground S that is extended by a top part $\mathbf{180}_2$ arranged out of the ground, as shown in FIG. 1.

In FIG. 1 the drive tube 14 is shown in its raised position, its position that it reaches after previously inserting the first anchor 22 and the bottom part $\mathbf{180}_1$ of the first drain portion 180 into the ground.

Thereafter, in accordance with the disclosure, the top part $\mathbf{180}_2$ of the first drain portion is blocked by clamping by causing the second roller 40 to pass into the active position, as shown in FIG. 3A; thereafter, where necessary, the drain is unwound so as to increase the length of the top part $\mathbf{180}_2$ of the first drain portion 180 by acting on the first and second rollers 38 and 40, as shown in FIG. 3B.

Thereafter, and as shown in FIG. 4A, the roll 52 is unrolled a little by causing the cylinders 64 and 66 to rotate in order to feed the second end part 54*a* of the strip into the assembly station 30. After that, and as shown in FIGS. 5A and 5B, the fastener device 70 and the cutter device 60 are actuated simultaneously in order firstly to cut a second anchor 90 from the strip 54 by using the blade 61 of the cutter device 60, and secondly to fasten the second anchor 90 to the second drain portion 182 by means of the above-described fastener device 70. It can thus be understood that the steps of cutting off the second anchor 90 and fastening it to the drain are performed together.

Figure 6:
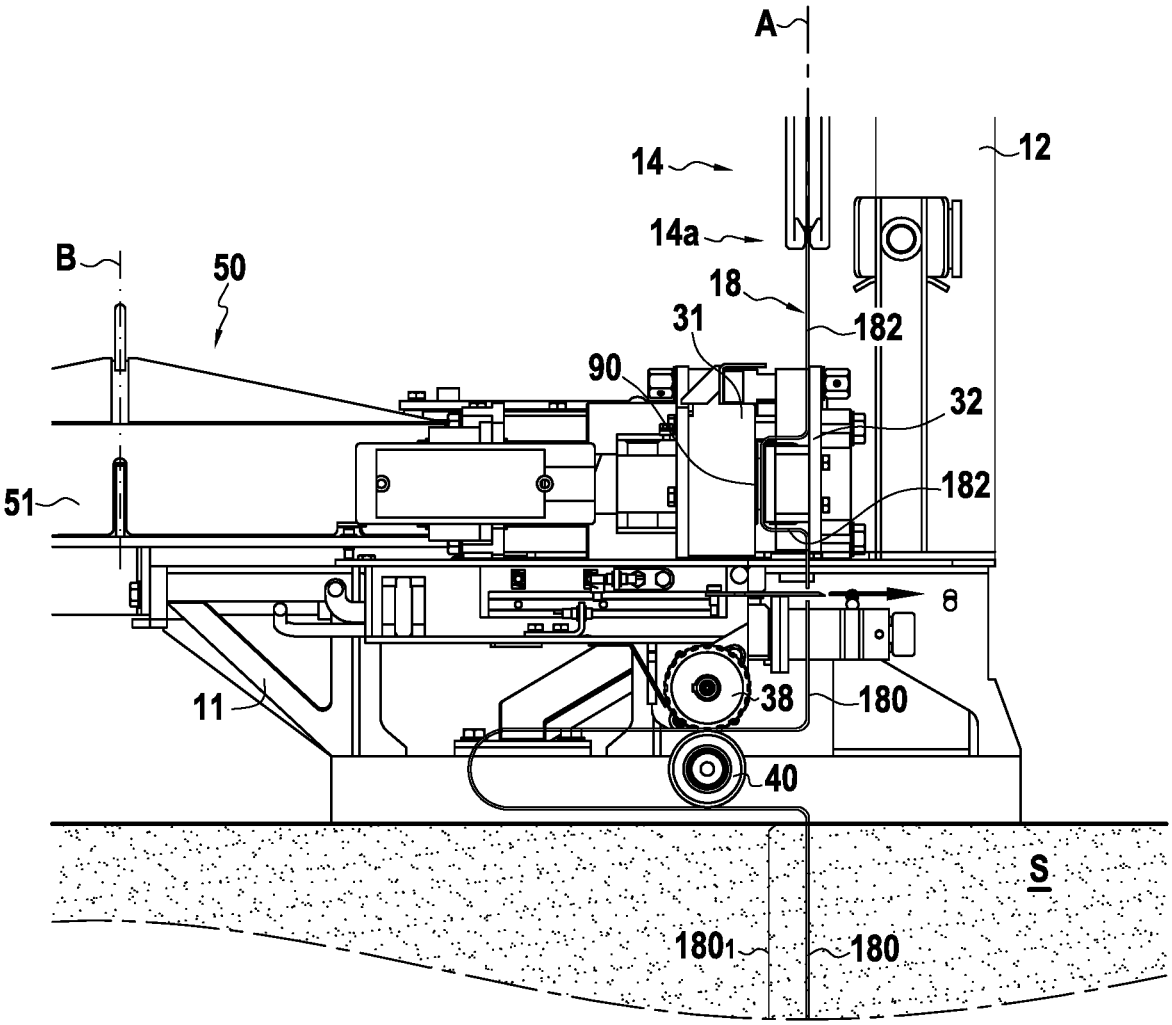
FIG. 6 shows the step of cutting the drain below the second anchor.

Thereafter, and as shown in FIG. 6, the drain is cut under the second anchor by using the cutter member 28 in order to separate the first drain portion 180 from the second drain portion 182.

During this operation of cutting the drain, the first drain portion 180 is blocked by being pinched between the first and second rollers, while the second drain portion 182 is blocked above the cutter member by being pinched between the body 32 and the stand 31.

Figure 7A:
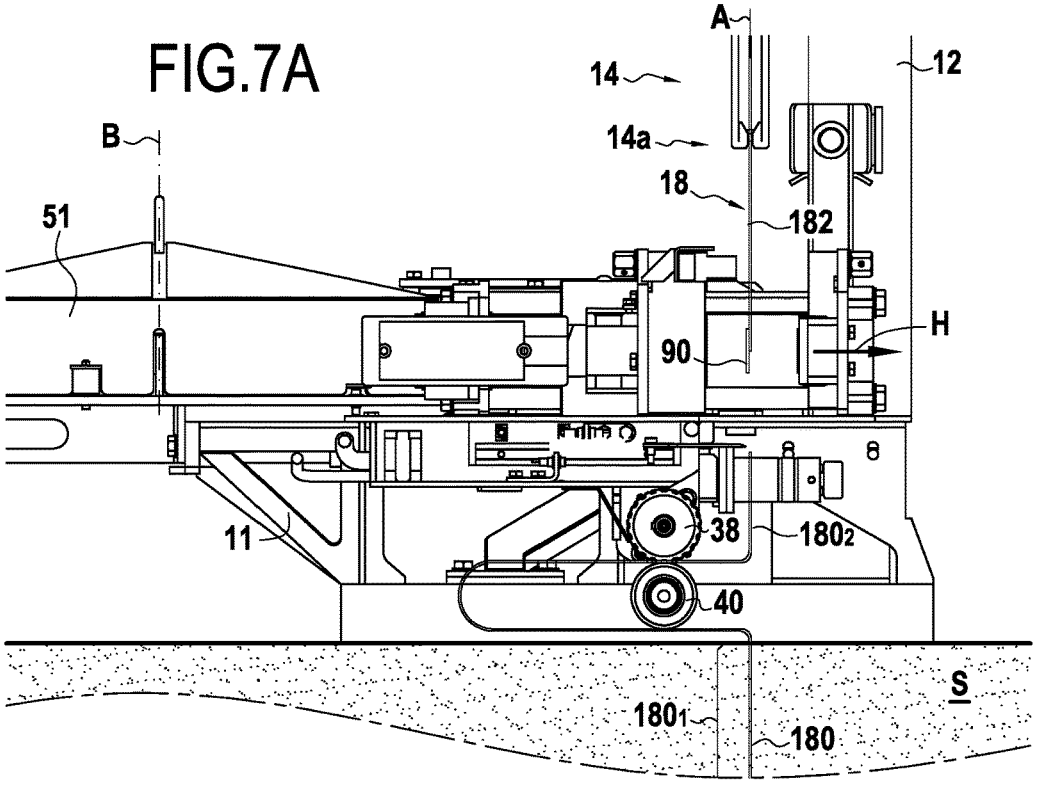
FIGS. 7A to 7C show the cutter device and the fastener device passing into the rest position, disengaging the drain to which the second anchor is fastened.
Figure 7B:
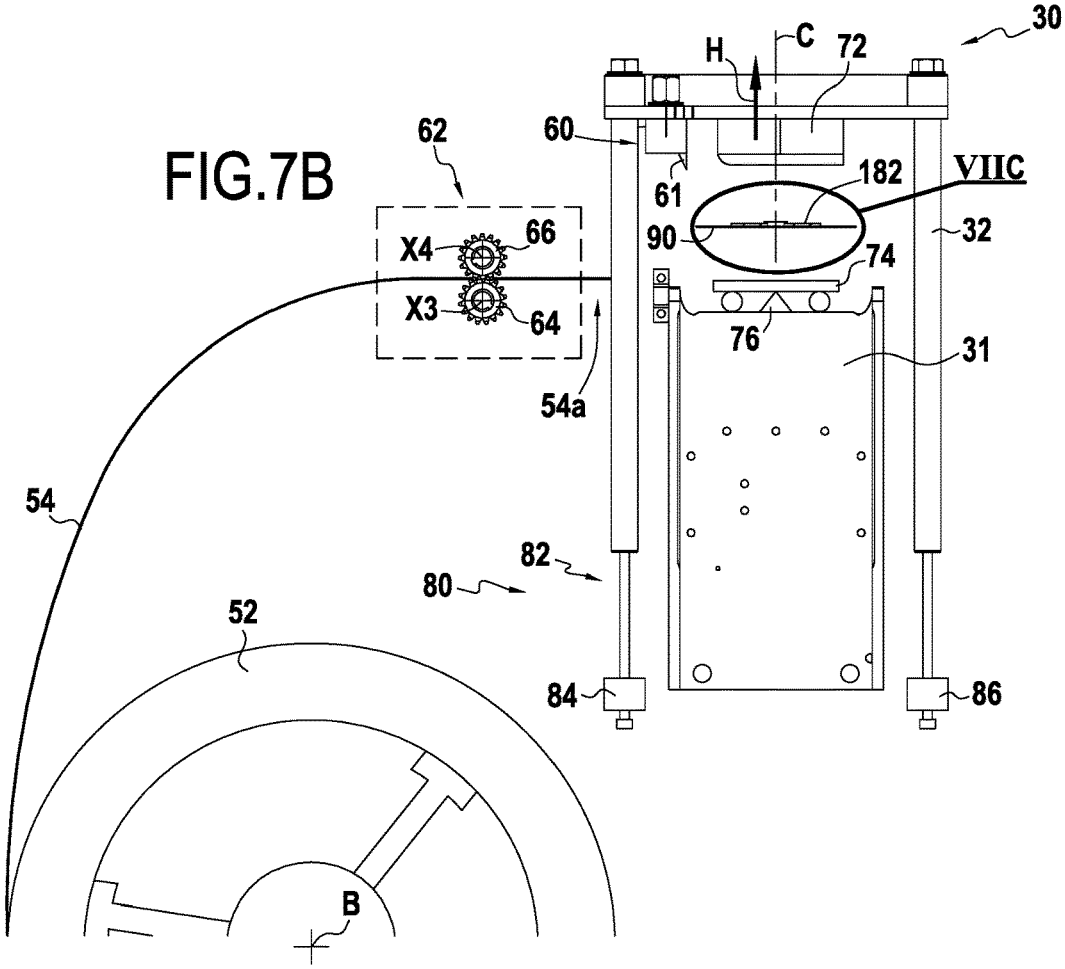
Figure 7C:
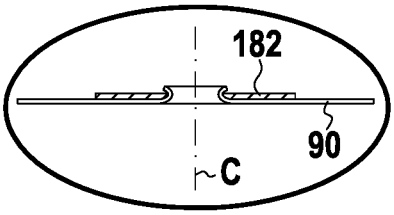

Thereafter, and as shown in FIGS. 7A, 7B and 7C, the second drain portion 182 attached to the second anchor 90 is released by moving the body 32 away from the stand 31 by moving along the direction C and in a movement direction H opposite to the movement direction G.

FIG. 7B shows more clearly the fastening of the second anchor 90 to the second drain portion 182 by crimping.

Figure 8:
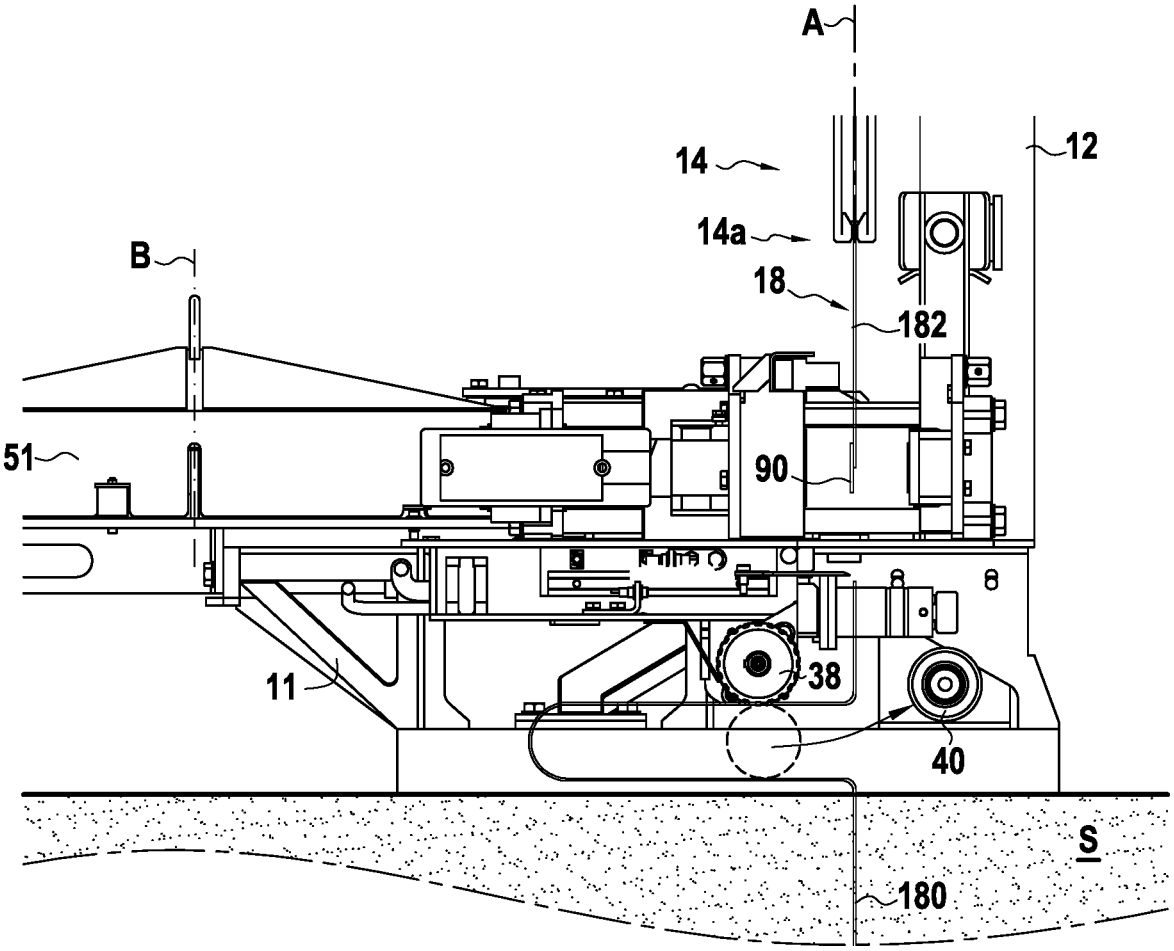
FIG. 8 shows the blocking device passing into the retracted position.
Figure 9:
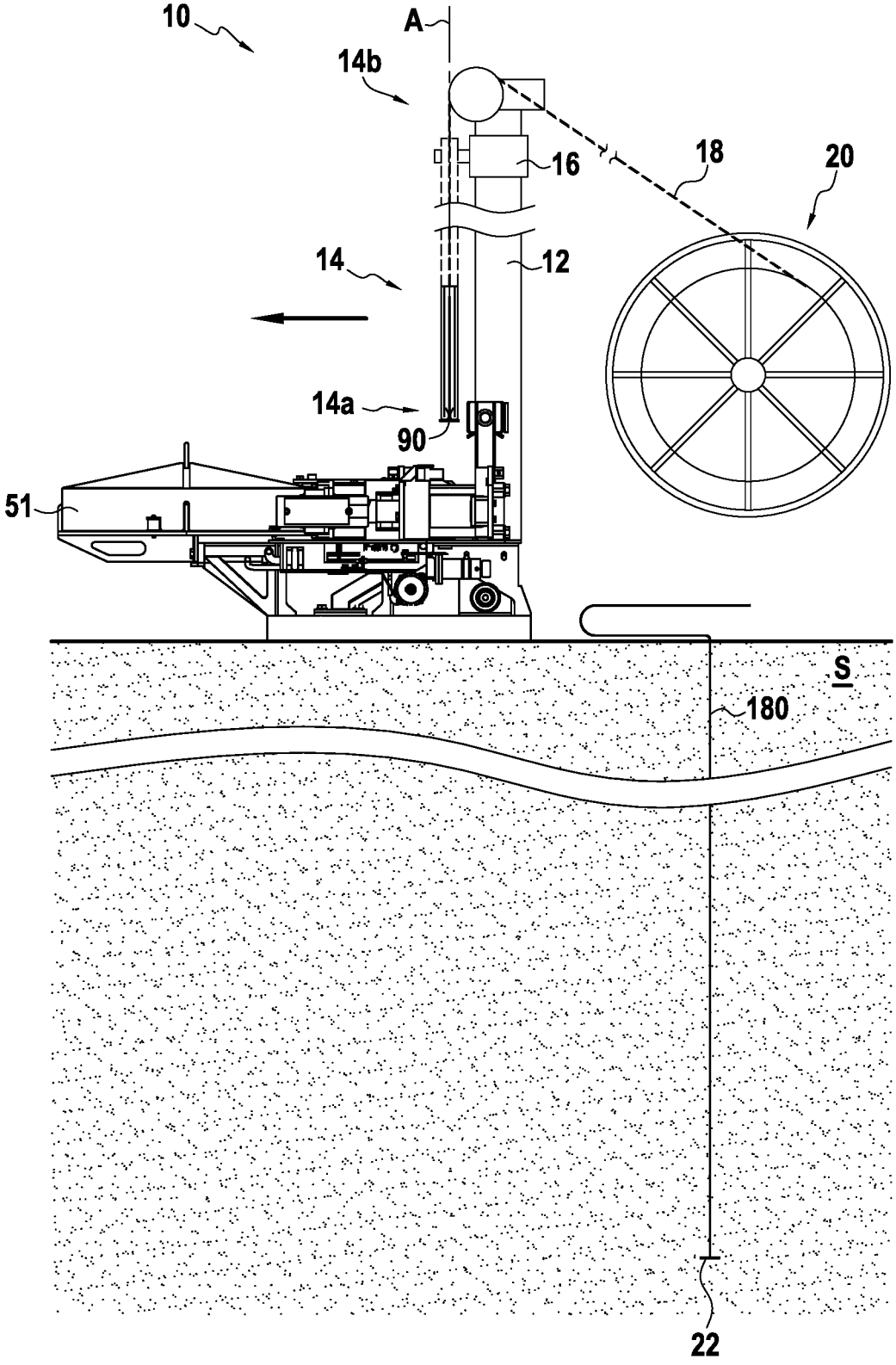
FIG. 9 shows the machine being moved.
Figure 10:
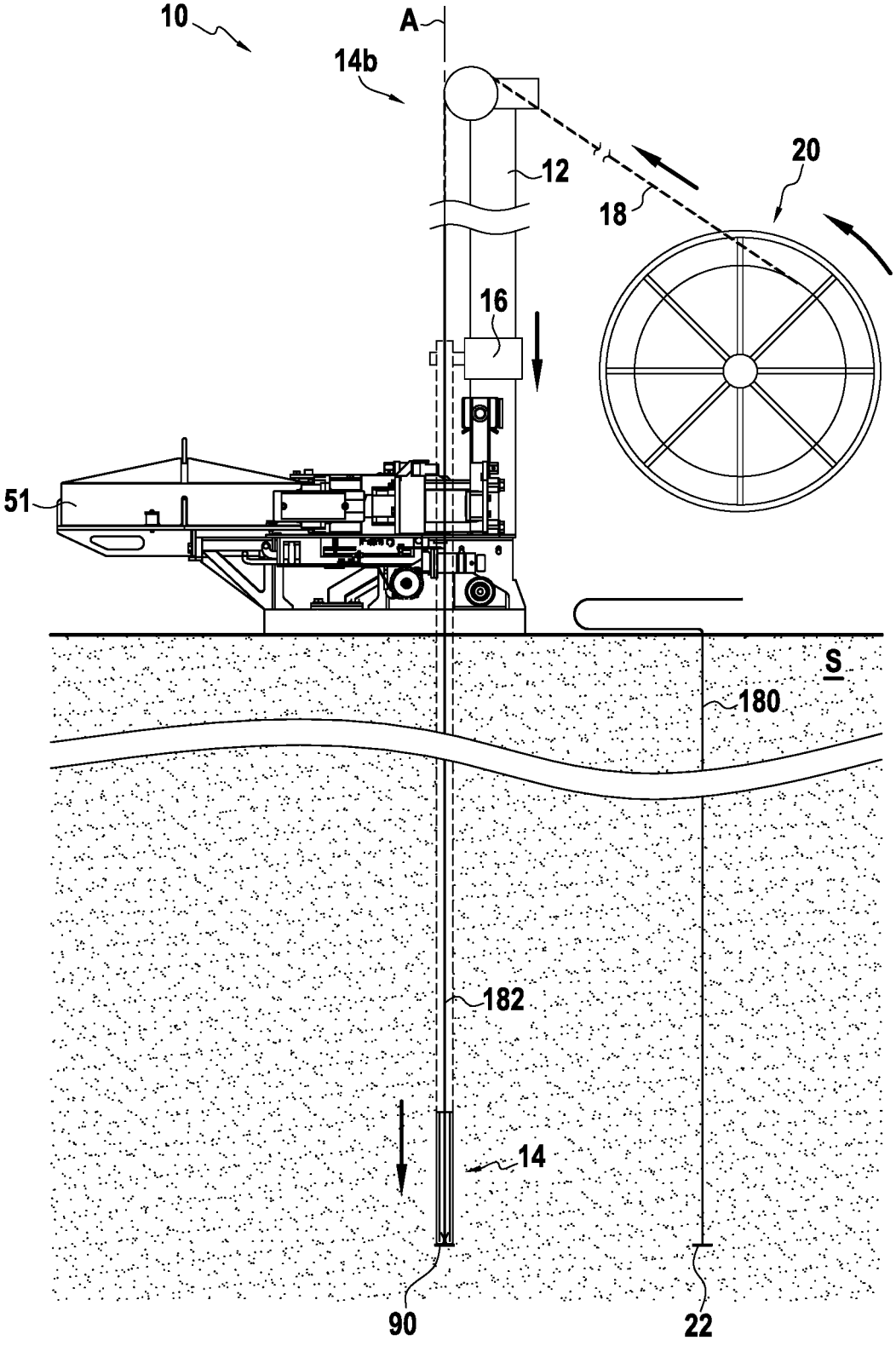
FIG. 10 shows the drive tube being inserted into the ground.

As shown in FIG. 8, the second roller 40 is then taken to the retracted position, prior to moving the machine 10 laterally in order to bring it towards another zone for draining. As shown in FIG. 9, traction is also exerted on the drain 18 by causing the winder 20 to turn so as to cause the second anchor 90 to rise and bring it into contact with the bottom end 14*a* of the drive tube 14. Thereafter, and as shown in FIG. 10, the second anchor 90 connected to the second drain portion 182 is driven into the ground S by moving the drive tube 14 into the ground S, in a vertical direction. As explained above, the drive tube is moved by moving the carriage 16 along the mast 12.

Figure 11:
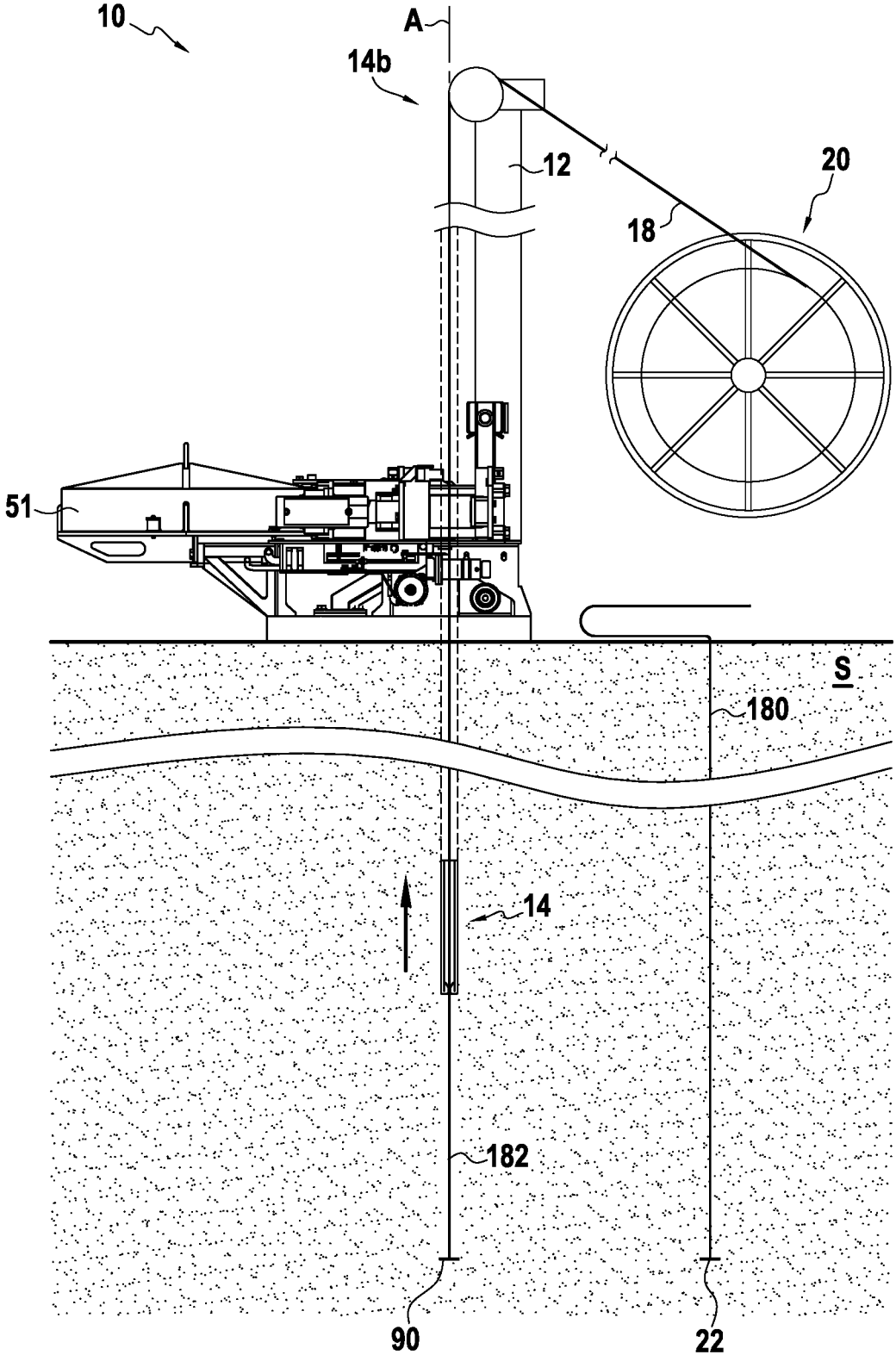
FIG. 11 shows the drive tube being raised while the second anchor remains in the ground with a part of the drain.

Eventually, in the step shown in FIG. 11, the drive tube 14 is raised by moving the carriage 12 in vertical translation. As a result of the action of the second anchor 90, the second anchor and a part of the second drain portion 182 remain in place in the ground.

Preferably, the steps starting from FIG. 1 are then repeated so as to put other drains into the ground S, with the anchors being cut successively from the strip 54.

Preferably, provision may be made to use a sensor in order to detect the position of the drive tube. In this variant, when the sensor detects that the drive tube is in the raised position, a control unit of the machine 10 starts sequenced actuation of the above described devices and members.

Once the entire strip 54 has been used up, the operator intervenes to change the roll by lifting the cover 51 that covers the reel 50. That is the only manual operation that is undertaken while performing the method of the disclosure, in addition to changing the drain roll. Furthermore, in this example, the devices and the members are actuated hydraulically by appropriate actuators.

Even though some features, concepts or aspects of the embodiments may be described herein as being a preferred (more or less) arrangement or method, or an advantageous arrangement or method, such description is not intended to suggest that such feature or features are required or necessary unless expressly so stated.

The invention claimed is:

1. A machine for putting a drain into place in ground, the machine comprising:

a drive tube presenting a longitudinal axis and having a bottom end;

a movement device for moving the drive tube in a direction parallel to the longitudinal axis;

a drain extending inside the drive tube and having a bottom end extending outside the drive tube;

an anchor cutter device for cutting an anchor from a rolled up strip;

a reel for receiving the rolled up strip, said reel being mounted to rotate about an axis of rotation that is parallel to the longitudinal axis of the drive tube;

a fastener device for fastening the anchor to the drain;

a drain cutter member for cutting the drain and arranged under the fastener device.

2. The machine according to claim 1, wherein the machine further comprises an actuator device for simultaneously actuating the anchor cutter device and the fastener device.

3. The machine according to claim 1, wherein the anchor cutter device comprises a blade for cutting the anchor from the strip.

4. The machine according to claim 1, including an assembly station which comprises the fastener device and the anchor cutter device, and a feeder device for feeding a free end part of the strip into the assembly station.

5. The machine according to claim 1, wherein the reel is mounted to rotate relative to a support of the machine.

6. The machine according to claim 1, further comprising a device for un-rolling the strip at least in part.

7. The machine according to claim 1, wherein the anchor cutter device includes an anchor length setting member for modifying a length of the anchor cut from the strip.

8. The machine according to claim 1, wherein the fastener device is configured to fasten the anchor to the drain by crimping.

9. The machine according to claim 1, further comprising an adjuster device for increasing a length of the drain portion that is located under the drain cutter member.

10. The machine according to claim 9, wherein the adjuster device comprises a first roller and a second roller that is movable relative to the first roller, the second roller presenting an active position and a retracted position, rotation of at least one of the first and second rollers being motor-driven, the first and second rollers being configured to pinch the drain when the second roller is in the active position so as to be able to un-roll the drain.

11. The machine according to claim 1, further comprising a blocking device for holding a drain portion that is located under the drain cutter member.

12. The machine according to claim 11, wherein said machine further comprises an adjuster device for increasing a length of the drain portion that is located under the anchor cutter device, and wherein the adjuster device and the blocking device form a single element.

13. The machine according to claim 1, further comprising a mast having a bottom end, the drive tube being movable relative to the mast in a substantially vertical direction, and wherein the anchor cutter device, the fastener device, and the drain cutter member for cutting the drain are arranged in a module that is releasably fastened to the bottom end of said mast.

14. A method of putting a drain into place in ground, the method comprising the following steps:

providing a rolled up strip;

providing a machine for putting a drain into place in ground, the machine comprising:

a drive tube presenting a longitudinal axis and having a bottom end;

a movement device for moving the drive tube in a direction parallel to the longitudinal axis;

a drain extending inside the drive tube and having a bottom end extending outside the drive tube;

an anchor cutter device for cutting a first anchor from a strip;

a fastener device for fastening the first anchor to the drain; and a drain cutter member for cutting the drain and arranged under the fastener device;

fastening the first anchor to the bottom end of the drain;

driving the first anchor connected to the drain into the ground by moving the drive tube vertically into the ground so that the drain presents a first drain portion extending between the first anchor and the drain cutter member, and a second drain portion located out of the ground and extending the first drain portion, the first drain portion presenting a bottom part arranged in the ground and a top part arranged out of the ground;

raising the drive tube, while leaving the first anchor and the bottom part of the first drain portion in the ground;

un-rolling a length of the strip and cutting a second anchor from the strip by using the anchor cutter device;

fastening the second anchor to the second drain portion by using the fastener device;

cutting the drain under the second anchor by using the drain cutter member in order to separate the first drain portion from the second drain portion;

moving the machine;

driving the second anchor connected to the second drain portion into the ground by moving the drive tube into the ground; and raising the drive tube while leaving the second anchor and a part of the second drain portion in the ground.

15. The method according to claim 14, wherein after raising the drive tube and before fastening the second anchor to the second drain portion, the drain is un-rolled in order to increase a length of the top part of the first drain portion.

16. The method according to claim 14, wherein the second anchor is cut from the strip while said second anchor is being fastened to the second drain portion.

17. The method according to claim 14, wherein at least one of the first drain portion or the second drain portion is blocked by pinching before cutting the drain.

18. A machine for putting a drain into place in ground, the machine comprising:

a drive tube presenting a longitudinal axis and having a bottom end;

a movement device for moving the drive tube in a direction parallel to the longitudinal axis;

a drain extending inside the drive tube and having a bottom end extending outside the drive tube;

an anchor cutter device for cutting an anchor from a strip;

a fastener device for fastening the anchor to the drain; and a drain cutter member separate from the anchor cutter device, for cutting the drain, the drain cutter member being arranged under the fastener device and under the anchor cutter device; and an actuator device for simultaneously actuating the anchor cutter device and the fastener device.

19. A machine for putting a drain into place in ground, the machine comprising:

a drive tube presenting a longitudinal axis and having a bottom end;

a movement device for moving the drive tube in a direction parallel to the longitudinal axis;

a drain extending inside the drive tube and having a bottom end extending outside the drive tube;

an anchor cutter device for cutting an anchor from a strip;

a fastener device for fastening the anchor to the drain; and a drain cutter member for cutting the drain and arranged under the fastener device; and a blocking device, located under the drain cutter member, for holding a drain portion that is located under the drain cutter member.

* * * * *